US009885372B2

(12) United States Patent
Arluck et al.

(10) Patent No.: US 9,885,372 B2
(45) Date of Patent: Feb. 6, 2018

(54) SYSTEM AND METHOD FOR A ROTOR ADVANCING TOOL

(71) Applicant: Energy Recovery, Inc., San Leandro, CA (US)

(72) Inventors: James Lee Arluck, Hayward, CA (US); Prem Krish, Foster City, CA (US); Jeremy Grant Martin, Oakland, CA (US); Felix Winkler, Oakland, CA (US); Alexander Patrick Theodossiou, San Francisco, CA (US)

(73) Assignee: ENERGY RECOVERY, INC., San Leandro, CA (US)

( * ) Notice: Subject to any disclaimer, the term of this patent is extended or adjusted under 35 U.S.C. 154(b) by 564 days.

(21) Appl. No.: 14/581,234

(22) Filed: Dec. 23, 2014

(65) Prior Publication Data

US 2015/0184678 A1 Jul. 2, 2015

Related U.S. Application Data

(60) Provisional application No. 61/922,488, filed on Dec. 31, 2013.

(51) Int. Cl.

| | |
|---|---|
| ***F04F 99/00*** | (2009.01) |
| ***F04F 13/00*** | (2009.01) |
| ***E21B 43/26*** | (2006.01) |

(52) U.S. Cl.

CPC ..... *F04F 13/00* (2013.01); *E21B 43/26* (2013.01); *Y10T 29/49718* (2015.01)

(58) Field of Classification Search

CPC .... F04F 13/00; B21D 43/26; Y10T 29/49718; E21B 43/26; B23P 6/002

USPC ..... 417/64

See application file for complete search history.

(56) References Cited

U.S. PATENT DOCUMENTS

| | | | | |
|---|---|---|---|---|
| 3,437,450 A * | 4/1969 | Greenwood | A61M 1/32 | 417/64 |
| 4,808,082 A * | 2/1989 | Kirchhofer | F02B 33/42 | 123/559.2 |
| 4,884,326 A * | 12/1989 | Porter | B23P 6/002 | 29/402.01 |
| 5,011,375 A * | 4/1991 | Mayer | F04F 13/00 | 417/64 |
| 5,338,158 A * | 8/1994 | Hauge | F04F 13/00 | 417/64 |
| 6,537,035 B2 * | 3/2003 | Shumway | B01D 61/06 | 417/64 |

* cited by examiner

*Primary Examiner* — Charles Freay
(74) *Attorney, Agent, or Firm* — Fletcher Yoder, P.C.

(57) ABSTRACT

A system includes an isobaric pressure exchanger (IPX) that includes a housing and a rotor disposed within the housing. The system also includes a rotor advancing tool configured to engage and to move the rotor while the rotor is within the housing. The housing includes an opening that enables the rotor advancing tool to extend through the opening to engage and move the rotor.

7 Claims, 8 Drawing Sheets

SYSTEM AND METHOD FOR A ROTOR ADVANCING TOOL

CROSS-SECTION TO RELATED APPLICATION

This application is a non-provisional of U.S. Provisional Patent Application No. 61/922,488, entitled "System and Method for a Rotor Advancing Tool," filed Dec. 31, 2013, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

The subject matter disclosed herein relates to rotating equipment, and, more particularly, to systems and methods for using a rotor advancing tool with an isobaric pressure exchanger (IPX).

Rotating equipment, such as IPXs, may handle a variety of fluids. Some of these fluids may include solids, such as particles, powders, debris, and so forth, which may interfere with the operation of the rotating equipment. In certain circumstances, the solids may prevent the rotating components of the rotating equipment from rotating. Thus, the rotating equipment may be taken out of service to enable the solids to be removed and/or enable the rotating components to be rotated. In addition, it may be useful to rotate the rotating components when the rotating equipment is not operating for a variety of reasons, such as verifying proper operation of the rotating equipment, testing sensors, and so forth.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
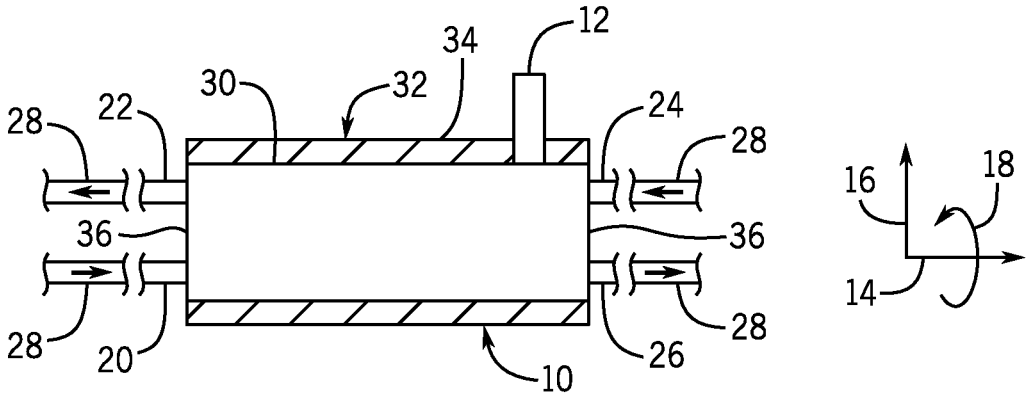
FIG. 1 is a schematic diagram of an embodiment of an isobaric pressure exchanger (IPX) and rotor advancing tool.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed in detail below, the disclosed embodiments relate generally to rotating equipment, and particularly to an isobaric pressure exchanger (IPX). For example, the IPX may handle a variety of fluids, some of which may include solid particles, powders, debris, and so forth. The IPX may include chambers wherein the pressures of two volumes of a liquid may equalize, as described in detail below. In some embodiments, the pressures of the two volumes of liquid may not completely equalize. Thus, the IPX may not only operate isobarically, but also substantially isobarically (e.g., wherein the pressures equalize within approximately +/−1, 2, 3, 4, 5, 6, 7, 8, 9, or 10 percent of each other). In certain embodiments, a first pressure of a first fluid may be greater than a second pressure of a second fluid. For example, the first pressure may be between approximately 6,000 kPa to 8,000 kPa, 6,500 kPa to 7,500 kPa, or 6,750 kPa to 7,250 kPa greater than the second pressure. Thus, the IPX may be used to transfer pressure from the first fluid to the second fluid.

In certain situations, it may be desirable to move, rotate, or advance certain components of the IPX when the IPX is not in operation. For example, the solids in the fluids flowing through the IPX may interfere with the rotation of certain rotating components of the IPX, such as a rotor. Thus, it may be desirable to rotate the rotor to overcome the interference of the solids. In other situations, it may be desirable to verify proper operation of the rotor and associated components, such as sensors, before placing the IPX in operation and/or during various maintenance procedures. Thus, in certain embodiments, a rotor advancing tool may be used to move, rotate, or advance the rotor without disconnecting the IPX from its associating piping, tubing, and/or conduits. For example, the rotor advancing tool may be placed through an opening of the IPX to engage with the rotor. In certain embodiments, the rotor advancing tool may be part of the IPX and configured to engage with the rotor when desired. Use of such embodiments of the rotor advancing tool may provide several advantages compared to other methods of rotating the rotor. For example, the IPX may remain coupled to its associating piping and conduits when embodiments of the rotor advancing tool are used, which may reduce the cost, time, and complexity associated with manipulating the rotor. In addition, the IPX may remain pressurized and/or the fluid may remain in the IPX during use of certain embodiments of the rotor advancing tool, which may not only reduce the potential for escape of the fluid from the IPX, but also reduce the cost, time, and complexity associated with manipulating the rotor. Further, the IPX is not disassembled or completely taken apart when embodiments of the rotor advanced tool are used. In other words, the rotor is not removed from the IPX when embodiments of the rotor advancing tool are used.

FIG. 1 is a schematic diagram of an embodiment of an isobaric pressure exchanger (IPX) 10 (e.g., rotary IPX) that may be used with the rotor advancing tool 12. In the following discussion, reference may be made to a longitudinal axis or axial direction 14, a radial axis or direction 16, and/or a circumferential axis or direction 18 of the IPX 10. As shown in FIG. 1, the IPX 10 may have a variety of fluid connections, such as a first fluid inlet 20, a first fluid outlet 22, a second fluid inlet 24, and/or a second fluid outlet 26. The fluid connections may be coupled to piping 28 that provides the fluids to the IPX 10. In certain embodiments, the first and/or second fluids may include solids, such as particles, powders, debris, and so forth. Each of the fluid connections to the IPX 10 may be made using flanged, fittings, threaded fittings, welded fittings, or other types of fittings. The IPX 10 may include a rotating component, such as a rotor 30, which may rotate in the circumferential direction 18. The rotor 30 is disposed within a housing 32. As described in greater detail below, the housing 30 may include a body portion or shell 34 and manifolds 36 at the ends of the body portion 34. The fluid connections (e.g., inlets 20, 24 and outlets 22, 26) may be disposed on the manifolds 36 or alternatively on both the body portion 34 and the manifolds 36 or solely on the body portion 34. In certain embodiments, the rotor 30 may be disposed within a sleeve (see FIG. 2) within the housing 32. In certain embodiments, the IPX 10 may not include a sleeve. Instead, in certain embodiments, the rotor 30 may rotate about an axle or stator. In certain embodiments, the rotor 30 may be disposed between a pair of end plates or end covers (see FIG. 2) that are disposed adjacent the ends of the body portion 34 within the manifolds 36. In addition, the rotor advancing tool 12 may be part of the IPX 10 or inserted into the IPX 10 (e.g., via an opening in the body portion 32 and/or manifolds 36 of the housing 32) to engage with the rotor 30, thereby enabling rotation of the rotor 30 when the IPX 10 is not in operation.

As used herein, the IPX 10 may be generally defined as a device that transfers fluid pressure between a high-pressure inlet stream and a low-pressure inlet stream at efficiencies in excess of approximately 50%, 60%, 70%, 80%, 90%, 95%, or 97% or greater without utilizing centrifugal technology. In this context, high pressure refers to pressures greater than the low pressure. The low-pressure inlet stream of the IPX 10 may be pressurized and exit the IPX 10 at high pressure (e.g., at a pressure greater than that of the low-pressure inlet stream), and the high-pressure inlet stream may be depressurized and exit the IPX 10 at low pressure (e.g., at a pressure less than that of the high-pressure inlet stream). Additionally, the IPX 10 may operate with the high-pressure fluid directly applying a force to pressurize the low-pressure fluid, with or without a fluid separator between the fluids. Examples of fluid separators that may be used with the IPX 10 include, but are not limited to, pistons, bladders, diaphragms and the like. In certain embodiments, isobaric pressure exchangers may be rotary devices. Rotary IPXs 10, such as those manufactured by Energy Recovery, Inc. of San Leandro, Calif., may not have any separate valves, since the effective valving action is accomplished internal to the device via the relative motion of the rotor 30 with respect to end covers, as described in detail below with respect to FIGS. 2-6. Rotary IPXs 10 may be designed to operate with or without internal pistons to isolate fluids and transfer pressure with little mixing of the inlet fluid streams. Reciprocating IPXs may include a piston moving back and forth in a cylinder for transferring pressure between the fluid streams. Any IPX or plurality of IPXs may be used in the disclosed embodiments, such as, but not limited to, rotary IPXs. While the discussion with respect to certain embodiments of the rotor advancing tool 12 may refer to rotary IPXs 10, it is understood that any IPX or plurality of IPXs may be substituted for the rotary IPX 10 in any of the disclosed embodiments. In addition, the IPX 10 may be disposed on a skid separate from the other components of a fluid handling system, which may be desirable in situations in which the IPX 10 is added to an existing fluid handling system.

Figure 2:
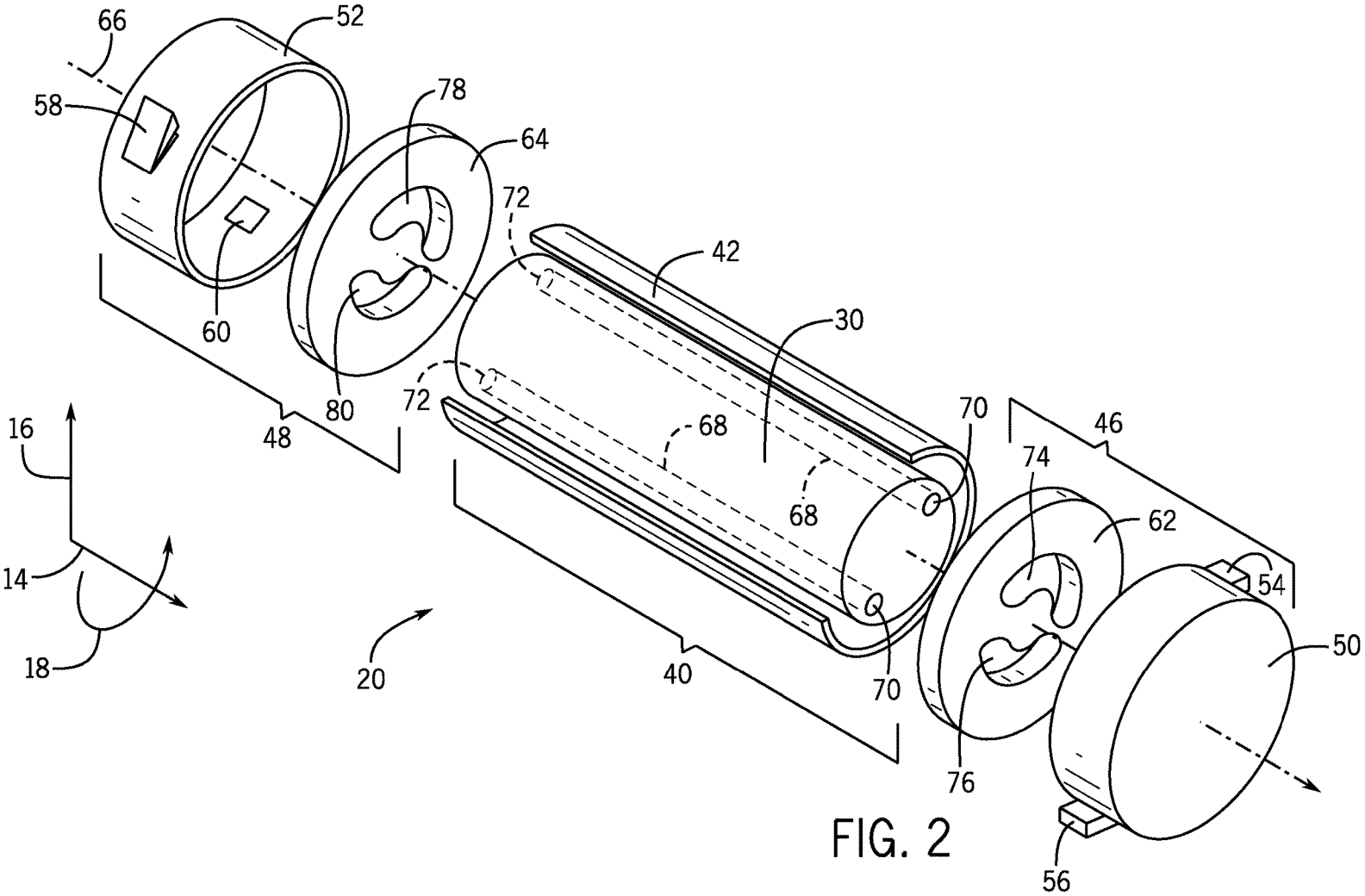
FIG. 2 is an exploded perspective view of an embodiment of a rotary IPX.

FIG. 2 is an exploded view of an embodiment of a rotary IPX 10. In the illustrated embodiment, the rotary IPX 10 may include a generally cylindrical body portion 40 that includes a sleeve 42 and a rotor 30. The cylindrical body portion 40 may be disposed within the body portion or shell 34 of the housing 32 (see FIGS. 1, 8, 9, 12). The rotary IPX 20 may also include two end structures 46 and 48 that include manifolds 50 and 52 (which form a portion of the housing 32), respectively. Manifold 50 includes inlet and outlet ports 54 and 56 and manifold 52 includes inlet and outlet ports 60 and 58. For example, inlet port 54 may receive a high-pressure first fluid and the outlet port 56 may be used to route a low-pressure first fluid away from the IPX 10. Similarly, inlet port 60 may receive a low-pressure second fluid and the outlet port 58 may be used to route a high-pressure second fluid away from the IPX 10. The end structures 46 and 48 include generally flat end plates or end covers 62 and 64, respectively, disposed within the manifolds 50 and 52, respectively, and adapted for liquid sealing contact with the rotor 30. The rotor 30 may be cylindrical and disposed in the sleeve 42, and is arranged for rotation about a longitudinal axis 66 of the rotor 30. The rotor 30 may have a plurality of channels 68 extending substantially longitudinally through the rotor 30 with openings 70 and 72 at each end arranged symmetrically about the longitudinal axis 66. The openings 70 and 72 of the rotor 30 are arranged for hydraulic communication with the end plates 62 and 64, and inlet and outlet apertures 74 and 76, and 78 and 80, in such a manner that during rotation they alternately hydraulically expose liquid at high pressure and liquid at low pressure to the respective manifolds 50 and 52. The inlet and outlet ports 54, 56, 58, and 60, of the manifolds 50 and 52 form at least one pair of ports for high-pressure liquid in one end element 46 or 48, and at least one pair of ports for low-pressure liquid in the opposite end element, 48 or 46. The end plates 62 and 64, and inlet and outlet apertures 74 and 76, and 78 and 80 are designed with perpendicular flow cross sections in the form of arcs or segments of a circle.

In addition, because the IPX 10 is configured to be exposed to the first and second fluids, certain components of the IPX 10 may be made from materials compatible with the components of the first and second fluids. In addition, certain components of the IPX 10 may be configured to be physically compatible with other components of the fluid handling system. For example, the ports 54, 56, 58, and 60 may comprise flanged connectors to be compatible with other flanged connectors present in the piping of the fluid handling system. In other embodiments, the ports 54, 56, 58, and 60 may comprise threaded or other types of connectors.

FIGS. 3-6 are exploded views of an embodiment of the rotary IPX 10 illustrating the sequence of positions of a single channel 68 in the rotor 30 as the channel 68 rotates through a complete cycle, and are useful to an understanding of the rotary IPX 20. It is noted that FIGS. 3-6 are simplifications of the rotary IPX 10 showing one channel 68 and the channel 68 is shown as having a circular cross-sectional shape. In other embodiments, the rotary IPX 10 may include a plurality of channels 68 with different cross-sectional shapes. Thus, FIGS. 3-6 are simplifications for purposes of illustration, and other embodiments of the rotary IPX 10 may have configurations different from that shown in FIGS. 3-6. As described in detail below, the rotary IPX 10 facilitates a hydraulic exchange of pressure between two liquids by putting them in momentary contact within a rotating chamber. In certain embodiments, this exchange happens at a high speed that results in very high efficiency with very little mixing of the liquids.

Figures 3, 4, 5, 6:
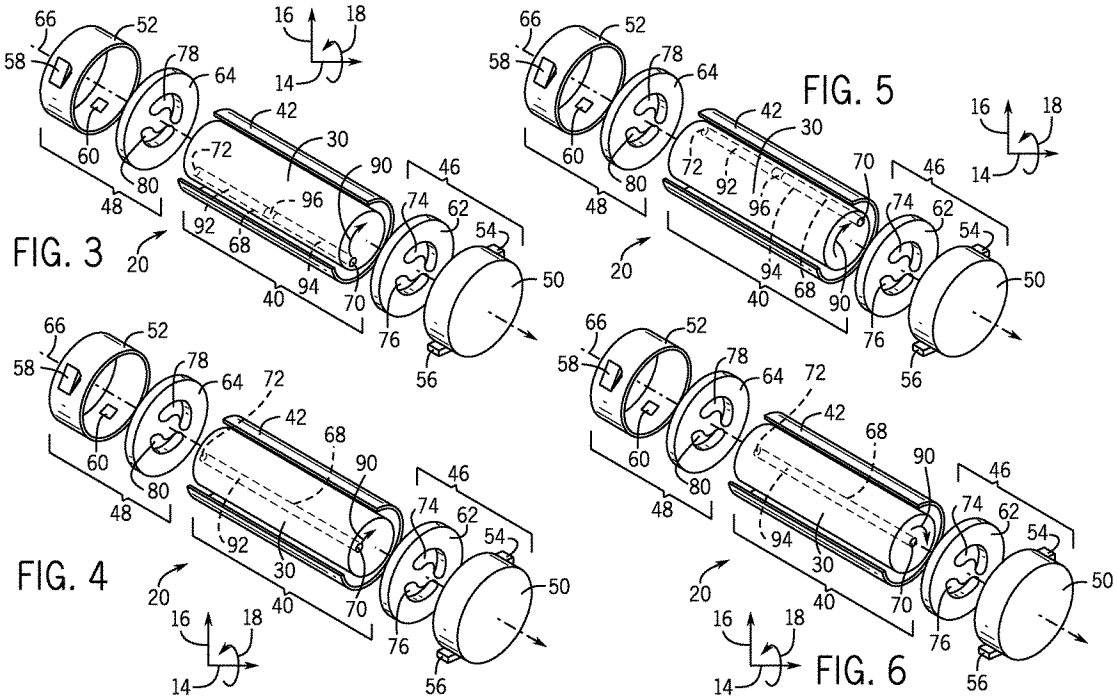
FIG. 3 is an exploded perspective view of an embodiment of a rotary IPX in a first operating position.
FIG. 4 is an exploded perspective view of an embodiment of a rotary IPX in a second operating position.
FIG. 5 is an exploded perspective view of an embodiment of a rotary IPX in a third operating position.
FIG. 6 is an exploded perspective view of an embodiment of a rotary IPX in a fourth operating position.

In FIG. 3, the channel opening 70 is in hydraulic communication with aperture 76 in endplate 62 and therefore with the manifold 50 at a first rotational position of the rotor 30 and opposite channel opening 72 is in hydraulic communication with the aperture 80 in endplate 64, and thus, in hydraulic communication with manifold 52. As discussed below, the rotor 30 rotates in the clockwise direction indicated by arrow 90. As shown in FIG. 3, low-pressure second fluid 92 passes through end plate 64 and enters the channel 68, where it pushes first fluid 94 out of the channel 68 and through end plate 62, thus exiting the rotary IPX 10. The first and second fluids 92 and 94 contact one another at an interface 96 where minimal mixing of the liquids occurs because of the short duration of contact. The interface 96 is a direct contact interface because the second fluid 92 directly contacts the first fluid 94.

In FIG. 4, the channel 68 has rotated clockwise through an arc of approximately 90 degrees, and outlet 72 is now blocked off between apertures 78 and 80 of end plate 64, and outlet 70 of the channel 68 is located between the apertures 74 and 76 of end plate 62 and, thus, blocked off from hydraulic communication with the manifold 50 of end structure 46. Thus, the low-pressure second fluid 92 is contained within the channel 68.

In FIG. 5, the channel 68 has rotated through approximately 180 degrees of arc from the position shown in FIG. 3. Opening 72 is in hydraulic communication with aperture 78 in end plate 64 and in hydraulic communication with manifold 52, and the opening 70 of the channel 68 is in hydraulic communication with aperture 74 of end plate 62 and with manifold 50 of end structure 46. The liquid in channel 68, which was at the pressure of manifold 52 of end structure 48, transfers this pressure to end structure 46 through outlet 70 and aperture 74, and comes to the pressure of manifold 50 of end structure 46. Thus, high-pressure first fluid 94 pressurizes and displaces the second fluid 92.

In FIG. 6, the channel 68 has rotated through approximately 270 degrees of arc from the position shown in FIG. 3, and the openings 70 and 72 of channel 68 are between apertures 74 and 76 of end plate 62, and between apertures 78 and 80 of end plate 64. Thus, the high-pressure first fluid 94 is contained within the channel 68. When the channel 68 rotates through approximately 360 degrees of arc from the position shown in FIG. 3, the second fluid 92 displaces the first fluid 94, restarting the cycle.

Figure 7:
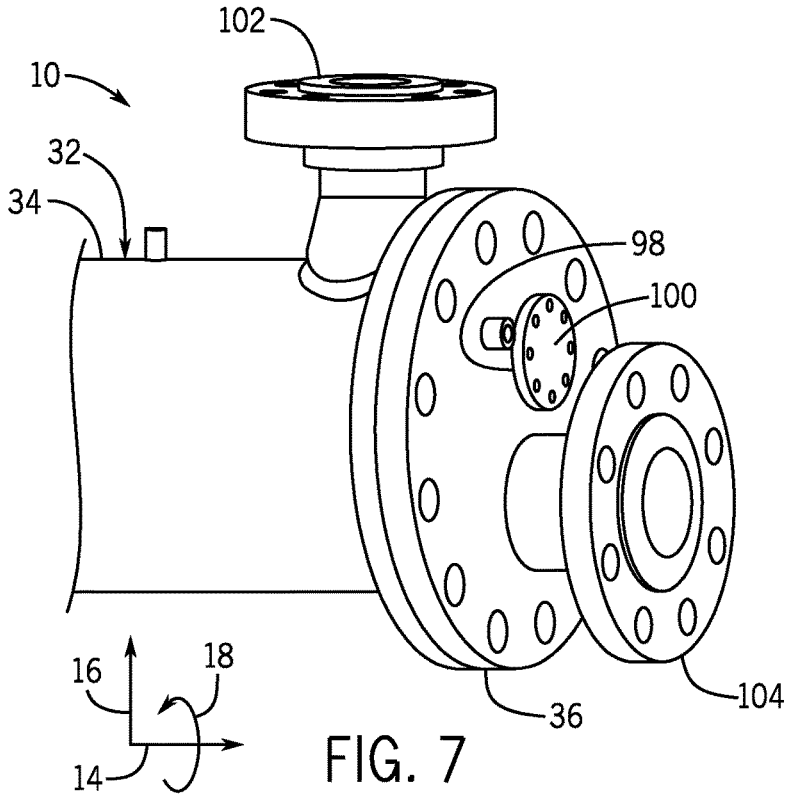
FIG. 7 is perspective view of a portion of an embodiment of a rotary IPX that may be used with a rotor advancing tool.

FIG. 7 is perspective view of a portion of an embodiment of a rotary IPX 10 that may be used with the rotor advancing tool 12. Specifically, the rotary IPX 10 may include an opening 98 through which the rotor advancing tool 12 may be inserted. A seal 100 (e.g., a removable cover such as a blind flange or access panel) may be used to cover the opening 98 when the rotary IPX 10 is in operation to help block fluids from escaping from the rotary IPX 10. A gasket or other sealing material may be used between the opening 98 and the blind flange or access panel 100 to help prevent leakage of fluids from the rotary IPX 10 when in operation. The blind flange or access panel 100 may be configured to be easily removed from the rotary IPX 10 without disconnecting the rotary IPX 10 from piping or other conduits coupled to the first and second fluids. The blind flange or access panel 100 may be coupled or fastened to the housing 32 via bolts, a threaded connection, or any other type fastening means. Thus, the rotary advancing tool 12 may be used to move (e.g., rotate and/or axially 14 move) the rotor 30 without disconnecting or removing the rotary IPX 10. As depicted in FIG. 7, the opening 98 and seal 100 are disposed on one of the manifolds 36 of the housing 32. In certain embodiments, the opening 98 and/or seal 100 may be disposed on the body portion 34 of the housing 32. Also, as depicted in FIG. 7, a fluid connection 102 is disposed on the body portion 34 of the housing and a fluid connection 104 is disposed on the manifold 36. The fluid connection 102 may function as the first fluid outlet 22 or the second fluid inlet 24, while the fluid connection 104 may function as the first fluid inlet 20 or the second fluid outlet 26. As noted above, in certain embodiments, the fluid connections 102, 104 may be disposed solely on the manifolds 36 or solely on the body portion 34 of the housing 32.

Figure 8:
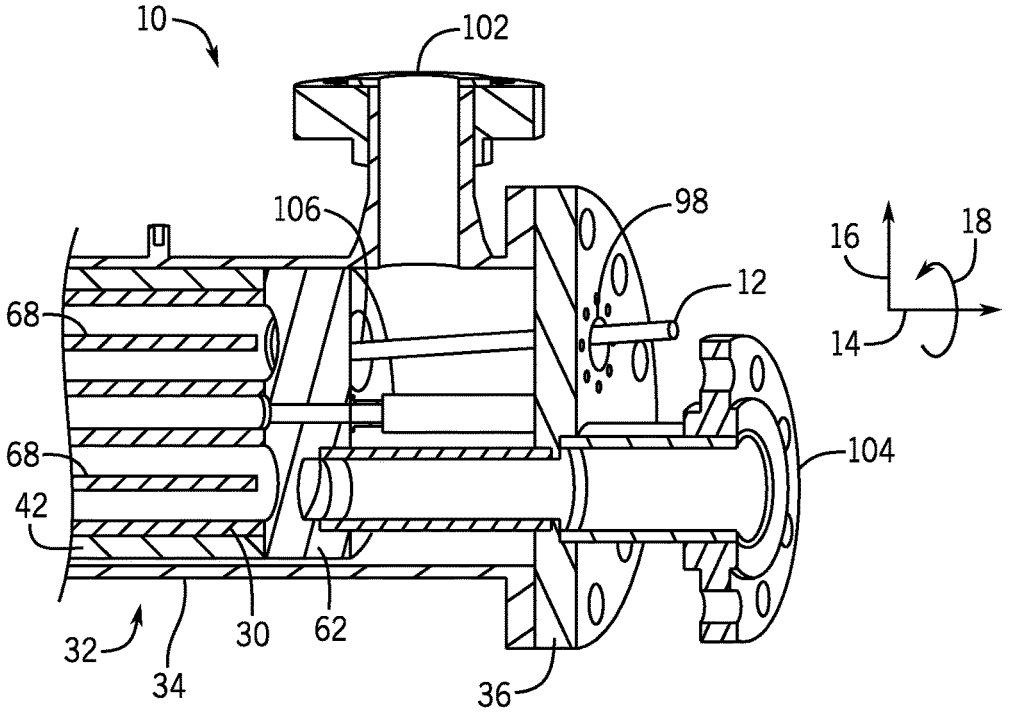
FIG. 8 is partial cutaway view of an embodiment of the rotary IPX of FIG. 7 and a rotor advancing tool.

FIG. 8 is partial cutaway view of an embodiment of the rotary IPX 10 of FIG. 7 and the rotor advancing tool 12. As shown in FIG. 8, the blind flange or access panel 100 has been removed (e.g., undoing bolts, threaded connection, etc.) thereby exposing the opening 98 through which the rotor advancing tool 12 may be inserted. In certain embodiments, the rotor advancing tool 12 may be a long, slender tool configured to be handled by hand or other devices (e.g., a powered actuator such as an electric drive, pneumatic drive, or hydraulic drive) to engage with and move the rotor 30. The rotor advancing tool 12 enables a torque and/or axial force to be applied from outside of the rotary IPX 10 to the rotor 30. In certain embodiments, a tip portion of the rotor advancing tool 12 may engage a rotor duct wall (e.g., inner wall of channel 68) and enable the rotation of the rotor 30 upon application of torque and/or axial movement of the rotor 30 upon application of an axial force. In certain embodiments, an inner surface of the rotor duct wall may include grooves, indentations, depressions, or other surface features configured to engage with a tip portion of the rotor advancing tool 12. In other embodiments, a longitudinal end of the rotor 30 may include one or more gears (e.g., disposed adjacent the channels 68) configured to engage with a tip portion of the rotor advancing tool 12. In certain embodiments, the rotor advancing tool 12 may be made from a material that is selected to be compatible with components of the rotary IPX 10. For example, the rotor advancing tool 12 may be made from a softer material than what the rotor 30 and/or other internal components of the rotary IPX 10 are made from to help avoid scratches, abrasions, and so forth. In certain embodiments, the rotary advancing tool 12 may be made from wood, plastic, fiberglass, nonmetals, composite materials, and so forth. In certain embodiments, the rotor advancing tool 12 may be made from hard metals but be covered in a protective coating (e.g., plastic coating, rubber coating, etc.) to avoid scratches, abrasions, and so forth. In certain embodiments, as shown in FIG. 8, the rotor advancing tool 12 may be inserted (e.g., axially 14) through both the opening 98 of the manifold 36 and an aperture or opening 106 of the end plate 62 to engage and move the rotor 30 (e.g., axially 14, radially 16, and/or circumferentially 18) with respect to the longitudinal axis 66 of the IPX 10.

Figure 9:
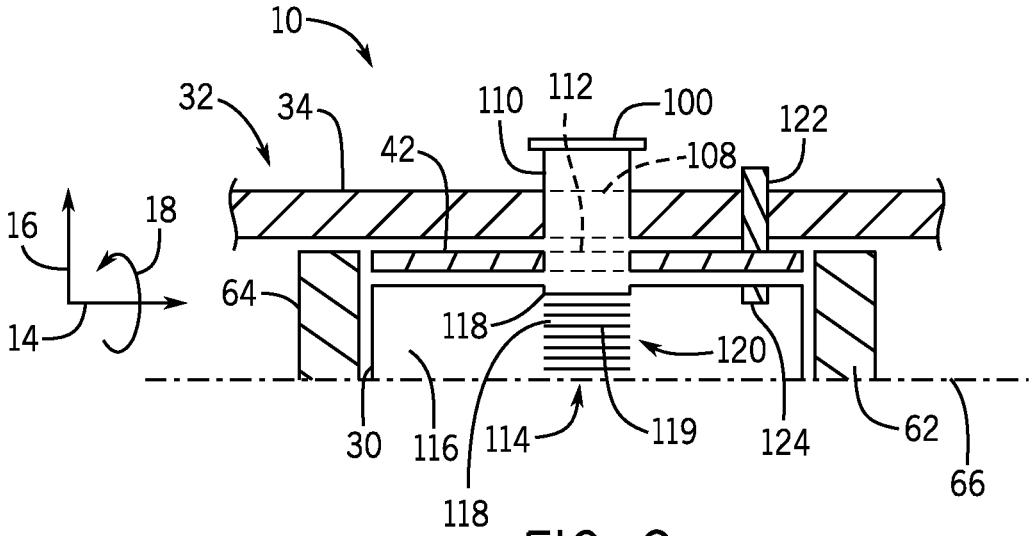
FIG. 9 is a cross-sectional axial view of a portion of an embodiment of a rotary IPX that may be used with a rotor advancing tool.

FIG. 9 is a cross-sectional axial view of a portion of an embodiment of the rotary IPX 10 that may be used with the rotor advancing tool 12. In the illustrated embodiment, an opening 108 is formed through the body portion or shell 34 of the housing 32. As depicted, in certain embodiments, the opening 108 may be located within a port 22 extending (e.g., radially 18) from the body portion 34 of the housing 32. In addition, an opening 112 is formed through the sleeve 42. The openings 110, 112 are radially 18 aligned with each other relative to the longitudinal axis 66 of the IPX 10. More specifically, the openings 108, 112 are radially 18 aligned at a common axial location 114 along the longitudinal axis 66. Again, the blind flange or access panel 100 may be used to block the opening 108 when the rotary IPX 10 is operating. To rotate the rotor 30, the blind flange or access panel 100 may be removed and the rotor advancing tool 12 passed through the openings 108, 122 in the body portion 34 and the sleeve 42 to engage with the rotor 30. In certain embodiments, an outer surface 122 of the rotor 30 may include one or more grooves 118 (e.g., indentations, depressions, or recesses) and/or protrusions 119 (e.g., teeth, gears, or tabs) to provide for engagement with the rotor advancing tool 12 (e.g., a tip of the rotor advancing tool 12, see FIG. 10). The grooves 118 and/or protrusions 119 extend longitudinally (e.g., axially 14) along at least a portion 120 of the outer surface 122 of the rotor 30 radially aligned with the openings 108, 112. In addition, the grooves 118 and/or protrusions 119 may be disposed circumferentially 18 about the outer surface 122 of the rotor 30. In certain embodiments, the grooves 118 may extend along the entire longitudinal length (e.g., in the axial direction 14) of the rotor 30. Such features 118 in the surface 116 of the rotor 30 may facilitate rotation of the rotor 30 using the rotor advancing tool 12 (see FIG. 10). In certain embodiments, the rotary IPX 10 may include a sensor 122, such as an RPM sensor, that interacts with a magnet 124 mounted or disposed in the rotor 30 to provide an indication of the rotational speed of the rotor 30. Thus, the rotor advancing tool 12 may be used to rotate the rotor 30 to test, calibrate, or verify operation of the RPM sensor 122 when the rotary IPX 10 is not in operation. In certain embodiments, the RPM sensor 122 may be communicatively coupled to a controller that can monitor and/or provide an indication of the rotational speed of the rotor 30 based on feedback from the sensor 122.

Figure 10:
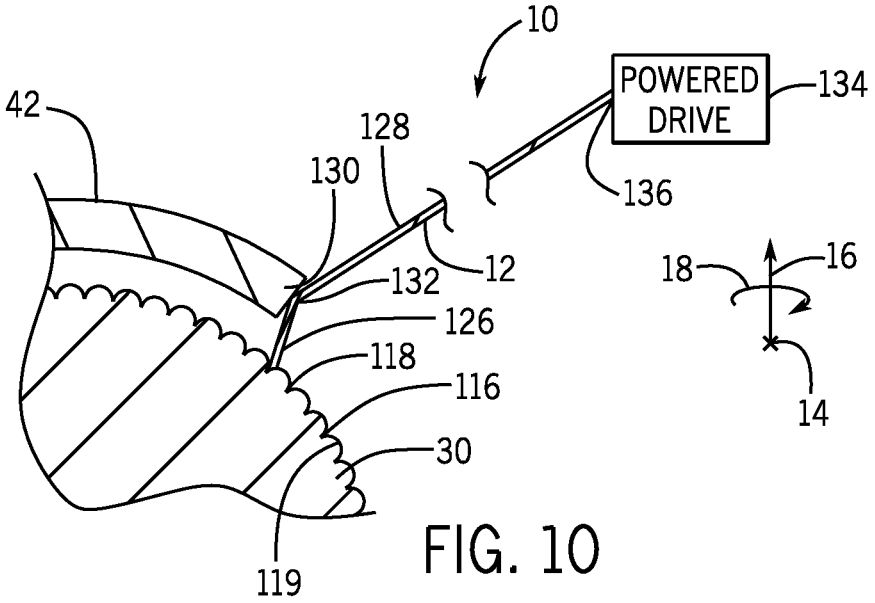
FIG. 10 is a cross-sectional radial view of a portion of an embodiment of a rotary IPX and a rotor advancing tool.

FIG. 10 is a cross-sectional radial view of a portion of an embodiment of the rotary IPX 10 and the rotor advancing tool 12. The IPX 10 is as generally described in FIG. 9. As shown in FIG. 10, the outer surface 116 of the rotor 30 may include a plurality of grooves 118 and/or protrusions 119 to engage with a tip 126 of the rotor advancing tool 12. The tip 126 extends from a main portion 128 of the rotor advancing tool 12. In the illustrated embodiment, the rotor advancing tool 12 may be bent or angled to help position the tool 12 against a stationary portion of the IPX 10 such as the sleeve 42 (e.g., along an inner surface 130 of the opening 112) to provide additional leverage against the rotor 30. In other embodiments, the rotor advancing tool 12 may be bent or angled to help position the tool 12 against another stationary portion of the IPX 10 such as the housing 32 (e.g., body portion 34). Specifically, the tip portion 126 extends from the main portion 128 of the rotor advancing tool 12 at an angle 132. In certain embodiments, a powered drive 134 (e.g., an electric drive, a hydraulic drive or piston, a pneumatic drive or piston, etc.) may be used to manipulate the rotor advancing tool 12. The hydraulic piston 134 is coupled to an end 136 of the rotor advancing tool 12 opposite the tip portion 126. In certain embodiments, a powered drive 134 may remain coupled to the rotary IPX 10 and at least a portion of the rotor advancing tool 12 may remain in the rotary IPX 10 (e.g., disposed through the openings 108 and/or 112) when the rotary IPX 10 is in operation. In such embodiments, the hydraulic piston 134 may be used to retract the rotor advancing tool 12 such that it does not interfere with rotation of the rotor 30 during operation of the IPX 10. When manipulation of the rotor 30 is desired, the rotary IPX 10 may be shut off and the hydraulic piston 34 used to place the rotor advancing tool 12 (e.g., tip portion 126) against the rotor 30. The use of a powered drive to actuate tool 12 may eliminate the need to open or even depressurize the IPX 10 prior to rotor advancement.

Figure 11:
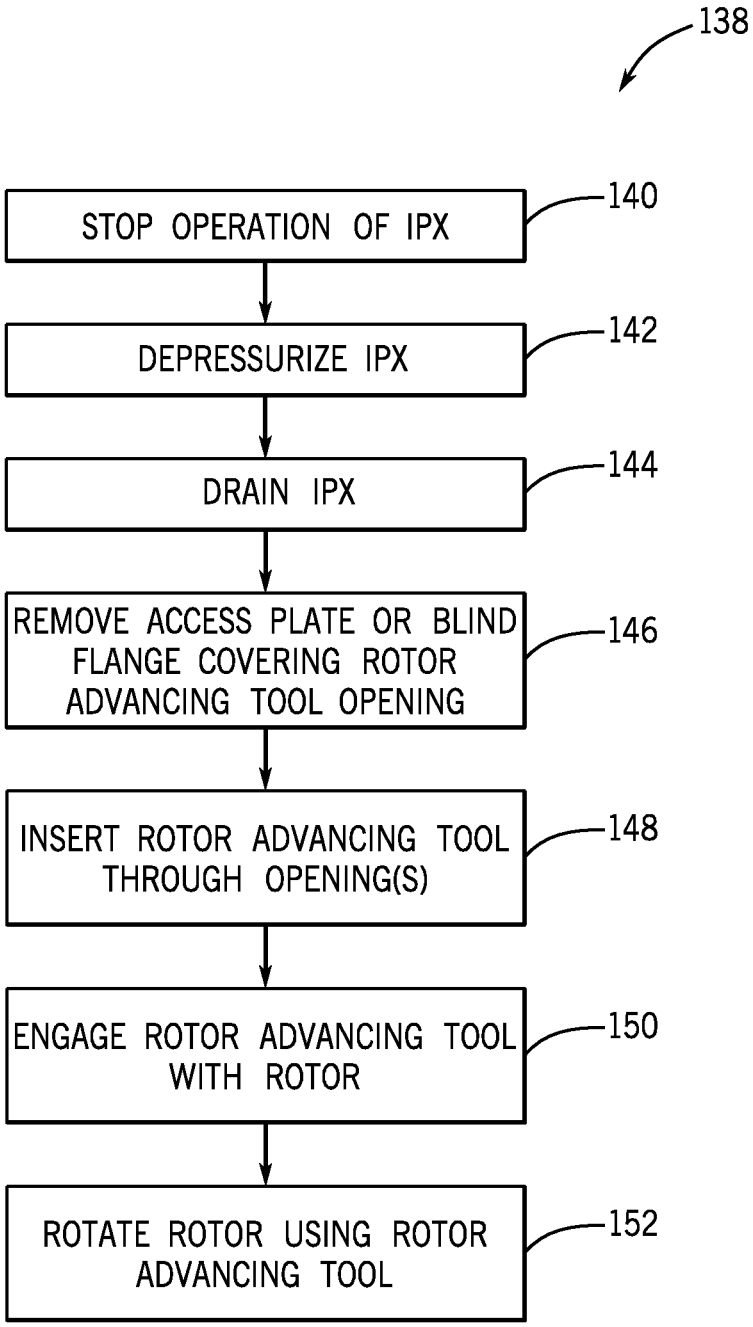
FIG. 11 is a flowchart of a method that may be used to rotate a rotor of an IPX with a rotor advancing tool.

FIG. 11 is a flowchart of a method 138 that may be used to rotate the rotor 30 of the IPX 10 with the rotor advancing tool 12, such as the rotor advancing tool 12 illustrated in FIG. 8. In a first step, operation of the IPX 10 may be stopped (block 140) and the IPX 10 may be isolated from the first and second fluid sources. In other words, the flow of the first and second fluids to and from the IPX 10 may be blocked using valves or similar devices, but the IPX 10 remains coupled to the piping, tubing, or other conduits. In a second step, the IPX 10 may be depressurized (block 142). In a third step, the IPX 10 may be drained of fluids (block 144). Next, the access plate or blind flange 100 may be removed from the opening 108 to enable access for the rotor advancing tool 12 (block 146) to the rotor 30. The first three steps may be performed to enable the rotor advancing tool 12 to be used while reducing the potential for release of fluids from the IPX 10. In a fifth step, the rotor advancing tool 12 may be inserted through the openings 108 and/or 110 (block 148). In a sixth step, the rotor advancing tool 12 (e.g., tip portion 126) may be engaged with the rotor 30, such as with a groove 118 and/or protrusion 119 formed in the external surface 116 of the rotor 30 (block 150). In a seventh step, the rotor 30 may be rotated (e.g., circumferentially) using the rotor advancing tool 12 (block 152). After the desired rotation of the rotor 30 is complete, the previous steps may be performed in reverse order to place the IPX 10 back into operation.

Figure 12:
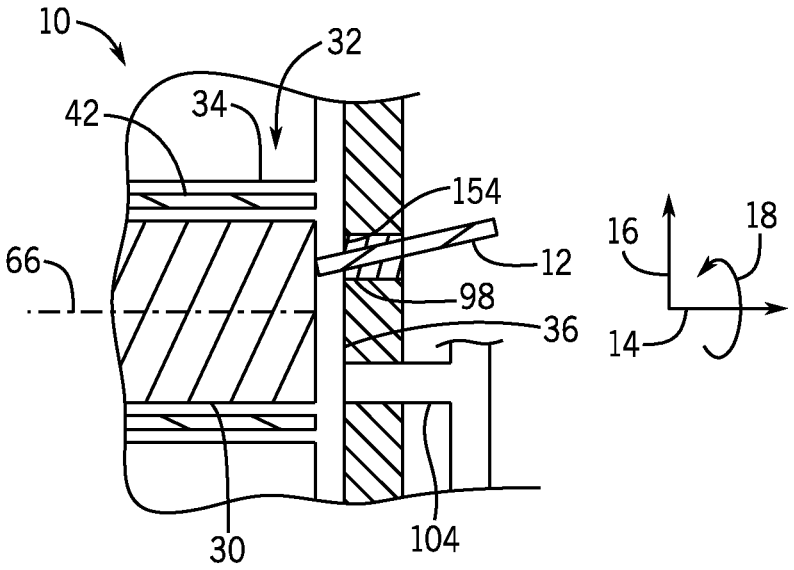
FIG. 12 is a cross-sectional axial view of a portion of an embodiment of a rotary IPX and a rotor advancing tool.

FIG. 12 is a cross-sectional axial view of a portion of an embodiment of the rotary IPX 10 and the rotor advancing tool 12. In general, the IPX 10 is similar to the IPX 10 described in FIG. 8. In the illustrated embodiment, a dynamic seal 154 may be disposed in the opening 98 for the rotor advancing tool 12. The dynamic seal 154 may be used to help block fluids from escaping from the IPX 10 when the IPX 10 is in operation or when the rotor advancing tool 12 is being used. Thus, the rotor advancing tool 12 may remain coupled to the IPX 10 and retracted a distance away from the rotor 30 when the IPX 10 is operating. When manipulation of the rotor 30 is desired, the rotor advancing tool 12 may be inserted into the IPX 10 to engage with the rotor 30, with the dynamic seal 154 (e.g., annular seal) continuing to help block leakage of fluids. Such an embodiment of the rotor advancing tool 12 and IPX 10 may be desirable because the rotor advancing tool 12 may be used without depressurization and/or draining of the IPX 10, thereby reducing the time, costs, and complexity associated with using the rotor advancing tool 12. The dynamic seal 154 may be made from any flexible material compatible with the first and second fluids, such as plastic or elastomeric materials. In certain embodiments, a flexible bellows or other arrangement may be used for the dynamic seal 154. As shown in FIG. 12, the rotor advancing tool 12 may be inserted (e.g., axially 14) through both the opening 98 and the dynamic seal 154 of the manifold 36 and an aperture or opening 106 of the end plate 62 to engage and move the rotor 30 (e.g., axially 14, radially 16, and/or circumferentially 18) with respect to the longitudinal axis 66 of the IPX 10. In certain embodiments, the rotor advancing tool 12 may be inserted also through an aperture or opening 106 of the end plate 62 to enable the tool 12 to engage the rotor 30 (see FIG. 8). In certain embodiments, the rotor advancing tool 12 may include a cylindrical rod surrounded by an annular seal that upon insertion within the opening 98 helps block leakage of fluid.

Figure 13:
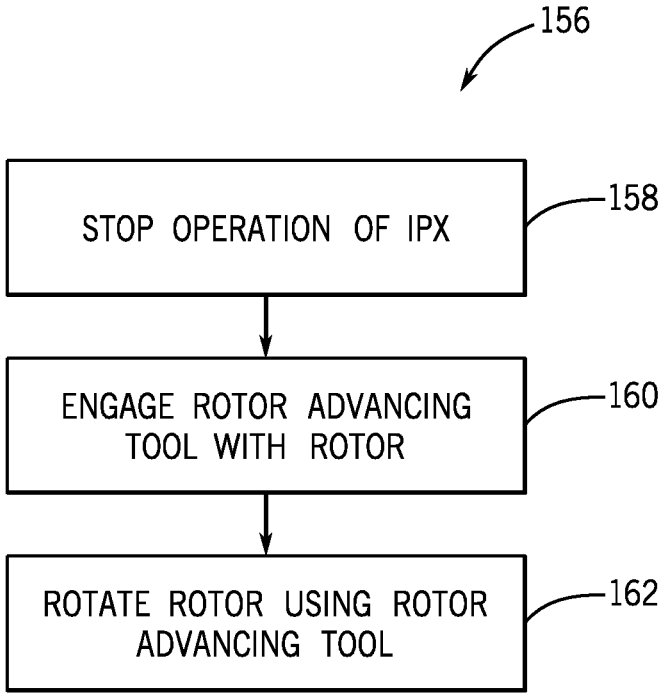
FIG. 13 is a flowchart of a method that may be used to rotate a rotor of an IPX with a rotor advancing tool.

FIG. 13 is a flowchart of a method 156 that may be used to rotate the rotor 30 of the IPX 10 with the rotor advancing tool 12, such as the rotor advancing tool 12 illustrated in FIG. 12. In a first step, operation of the IPX 10 may be stopped (block 158). In certain embodiments, the IPX 10 is not isolated from the first and second fluid sources to enable the rotor advancing tool 12 to be used. In other words, the first and second fluids may continue to flow in and out of the IPX 10 when the rotor advancing tool 12 is used. In certain embodiments, operation of the IPX 10 may not be stopped prior to insertion of the rotor advancing tool 12. In a second step, the rotor advancing tool 12 may be engaged with the rotor 30, such as with a groove 118 and/or protrusion 119 formed in the external surface 116 of the rotor 30 (block 160). Because of the dynamic seal 154, depressurization and/or draining of the IPX 10 may not be performed. In a third step, the rotor 30 may be rotated using the rotor advancing tool 12 (block 162). After the desired rotation of the rotor 30 is complete, the previous steps may be performed in reverse order to place the IPX 10 back into operation.

Figure 14:
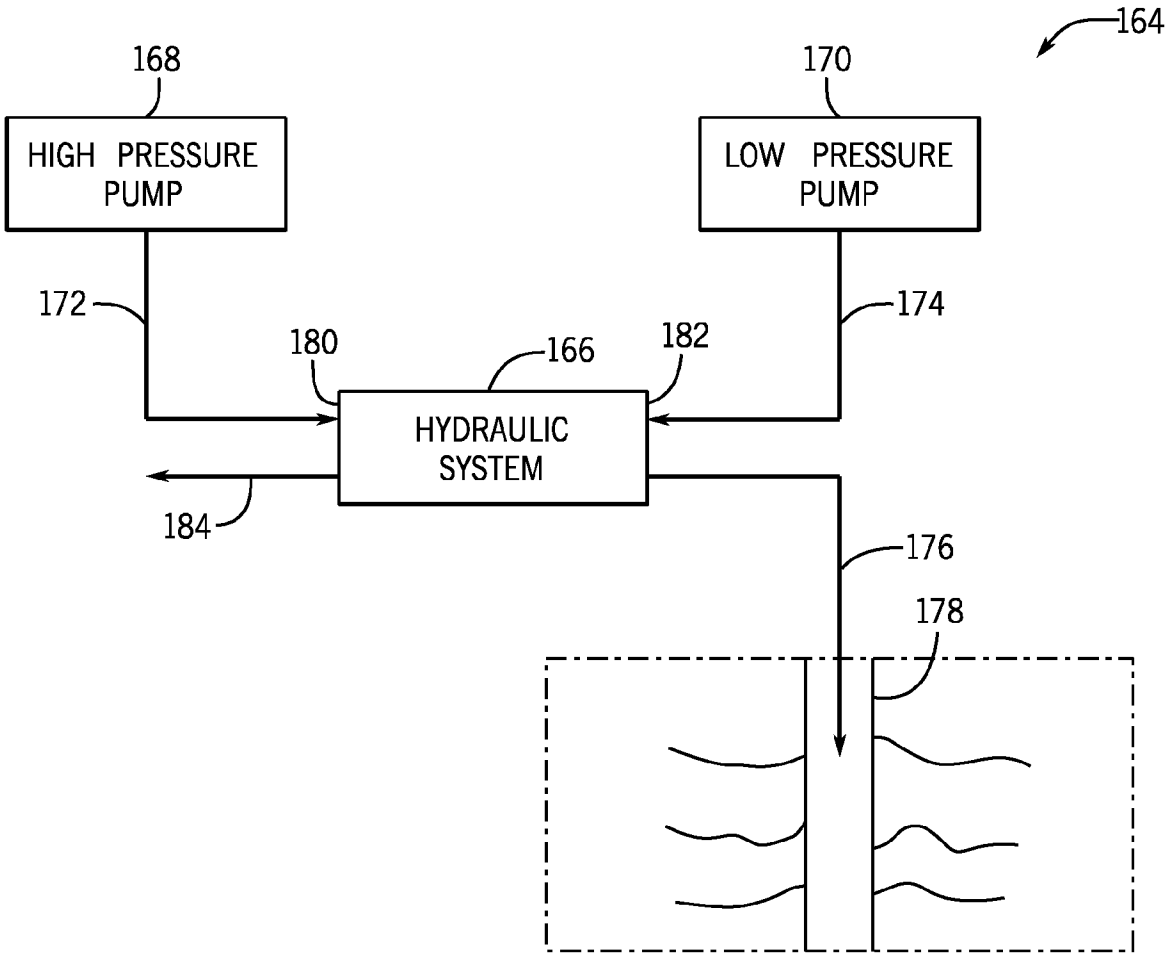
FIG. 14 is a schematic diagram of an embodiment of a frac system with a hydraulic energy transfer system.

FIG. 14 is a schematic diagram of an embodiment of the frac system 164 with a hydraulic energy transfer system 166 that may utilize the above described rotary IPX 10. In operation, the frac system 164 enables well completion operations to increase the release of oil and gas in rock formations. Specifically, the frac system 164 pumps a frac fluid containing a combination of water, chemicals, and proppant (e.g., sand, ceramics, etc.) into a well at high-pressures. The high-pressures of the frac fluid increases crack size and propagation through the rock formation, which releases more oil and gas, while the proppant prevents the cracks from closing once the frac fluid is depressurized. As illustrated, the frac system 164 includes a high-pressure pump 168 and a low-pressure pump 170 coupled to the hydraulic energy transfer system 166 (e.g., the rotary IPX 10 described above). In operation, the hydraulic energy transfer system 166 transfers pressures between a first fluid (e.g., proppant free fluid) pumped by the high-pressure pump 168, represented by reference numeral 172, and a second fluid (e.g., proppant containing fluid or frac fluid) pumped by the low-pressure pump, as represented by reference numeral 174. In this manner, the hydraulic energy transfer system 166 blocks or limits wear on the high-pressure pump 168, while enabling the frac system 164 to pump a high-pressure frac fluid 176 into a well 178 to release oil and gas.

In an embodiment using the IPX 10, the first fluid 172 (e.g., high-pressure proppant free fluid) enters a first side 180 of the hydraulic energy transfer system 166 where the first fluid 12 contacts the second fluid 174 (e.g., low-pressure frac fluid) entering the IPX 10 on a second side 182. The contact between the fluids 172, 174 enables the first fluid 172 to increase the pressure of the second fluid 174, which drives the second fluid 174 out of the IPX 10, as represented by reference numeral 176, and down the well 178 for fracturing operations. The first fluid 172 similarly exits the IPX 10, as represented by reference numeral 184, but at a low-pressure after exchanging pressure with the second fluid 174. In certain embodiments, debris (e.g., from the proppants may stall or slow down the rotor 30. Thus, the rotor advancing tool 12 may be utilized as described above to move the rotor 30.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

an isobaric pressure exchanger (IPX) comprising:

a housing, wherein the housing comprises a body portion and first and second manifolds disposed at opposite ends of the body portion;

a rotor disposed within the housing; and a sleeve disposed about the rotor between the body portion and the first and second manifolds; and a rotor advancing tool configured to engage and to move the rotor while the rotor is within the housing;

wherein the housing comprises an opening that enables the rotor advancing tool to extend through the opening to engage and to move the rotor, wherein the opening is disposed on the body portion, and wherein the sleeve comprises a sleeve opening radially aligned relative to a longitudinal axis of the IPX with the opening of the housing, and the sleeve opening enables the rotor advancing tool to extend through the sleeve to engage and to move the rotor.

2. The system of claim 1, wherein the rotor comprises one or more grooves or protrusions that extend longitudinally at least along a portion of an outer surface of the rotor radially aligned relative to the longitudinal axis with the opening, and the one or more grooves or protrusions are configured to enable engagement with a tip portion of the rotor advancing tool.

3. The system of claim 1, comprising a removable cover disposed over the opening to block fluid from leaking from the IPX.

4. The system of claim 1, wherein at least a portion of the rotor advancing tool is configured to remain disposed within the IPX when the IPX is in operation.

5. A method for moving a rotor of an isobaric pressure exchanger (IPX), comprising:

stopping operation of the IPX prior to engaging the rotor with a rotor advancing tool;

depressurizing the IPX subsequent to stopping operation of the IPX and prior to engaging the rotor advancing tool with the rotor;

engaging the rotor with the rotor advancing tool by extending the rotor advancing through an opening of a housing of the IPX while the IPX is still coupled to external piping that provides fluids to the IPX, wherein the rotor is disposed within the housing; and moving the rotor with the rotor advancing tool.

6. The method of claim 5, comprising draining fluids from the IPX subsequent to stopping operation of the IPX and prior to engaging the rotor advancing tool with the rotor.

7. The method of claim 5, removing a cover disposed over the opening prior to extending the rotor advancing tool through the opening.

* * * * *